US006141918A

United States Patent [19]

Wrightson

[11] Patent Number: 6,141,918

[45] Date of Patent: Nov. 7, 2000

[54] PREFORMED CASTING FOR CONCRETE DEADMAN

[76] Inventor: Francis J Wrightson, 244 Arch Rd., Chesapeake, Va. 23320

[21] Appl. No.: 09/370,615

[22] Filed: Aug. 7, 1999

[51] Int. Cl.[7] ..... E04B 1/00

[52] U.S. Cl. ..... 52/127.4; 52/166; 52/742.14

[58] Field of Search ..... 52/127.3, 127.4, 52/166, 742.14

[56] References Cited

U.S. PATENT DOCUMENTS

| | | | |
|---|---|---|---|
| 791,975 | 6/1905 | Allen | 52/166 |
| 1,746,848 | 2/1930 | Bates | 52/166 |
| 3,115,226 | 12/1963 | Thompson | 52/166 |
| 3,462,896 | 8/1969 | Lokensgaard . | |
| 3,717,966 | 2/1973 | Reichert | 52/127.4 |
| 5,012,622 | 5/1991 | Sato et al. | 52/742.14 |
| 5,040,344 | 8/1991 | Durand . | |
| 5,564,236 | 10/1996 | McKinney et al. . | |
| 5,655,337 | 8/1997 | Bryant et al. . | |

*Primary Examiner*—Peter M. Cuomo
*Assistant Examiner*—Jerry Anderson
*Attorney, Agent, or Firm*—Michael I. Kroll

[57] ABSTRACT

The present invention 10 discloses a device to aid in providing ballast to place an object, e.g., a tank 16, underground. The device comprises a pair of generally horizontal elongated cylindrical members 30 having a bell 58 and spigot 60 type end for being joined together. A pair of upstanding cylindrical members 26 are provided on the horizontal cylindrical member 30 for connection to a source of pumpable concrete 48. Concrete 48 is pumped into one upright member 26 and air 50 is allowed to pass out the other upright member. Means 36 are provided for closing the ends of the horizontal member 30 so that concrete 48 will not leak out, with the means 36 using rebars 34 and, e.g., steel tek 52. Means 41 are also provided to the cylindrical members for attaching coupling cables 42 thereto so that the object, e.g., tank 16, can be properly ballasted.

15 Claims, 10 Drawing Sheets

PREFORMED CASTING FOR CONCRETE DEADMAN

BACKGROUND OF THE INVENTION

1. Field of the Invention

The present invention relates generally to ballast for underground tanks and, more specifically, to a lightweight ballast form, constructed from polypropylene, plastic fibers, or other durable lightweight composite materials. Said lightweight ballast form is comprised of a first container member having conduit-like second members providing means for access to said first container member and forming an integral part of said first container member. Said second conduit-like members providing means for injecting a suitable material, such as concrete, into the cavity of said first container member.

In addition said lightweight ballast form having means for connecting a plurality of first container members creating a ballast of variable length depending on job site requirements.

Further said lightweight ballast form can be attached to an underground tank before placement of said tank into an excavation site whereby said underground tank and said lightweight ballast form can be placed into the excavation as one assembly and concrete or other suitable ballast material can be pumped into said first container member or members by means of said second access member or members until said first container member has a predetermined amount of ballast material contained therein. Whereupon the excavation can be backfilled to a predetermined level before personnel enter the excavation thereby reducing the job site risk of injury to the personnel and decreasing the need for elaborate shoring of the excavation due to the presence of personnel during placement of the underground tank, precast ballast or construction of forms within the excavation for filling with an appropriate ballast material.

2. Description of the Prior Art

There are other forms and methods for constructing support devices for forms. Typical of these is U.S. Pat. No. 5,040,344 issued to Durand on Aug. 20, 1991.

Another patent was issued to Bryant et al. on Aug. 12, 1997 as U.S. Pat. No. 5,655,337. Yet another U.S. Pat. No. 5,564,236 was issued to McKinney et al. on Oct. 15, 1996 and still yet another was issued on Aug. 26, 1969 to Lokensgaard as U.S. Pat. No. 3,462,896.

U.S. Pat. No. 5,040,344

Inventor: Philippe Durand

Issued: Aug. 20, 1991

Prefabricated formwork elements for the construction of external walls of buildings comprise at least one pair of panels (1,2) of heat-insulating material which are intended to be maintained in parallel relation in order to delimit between them a space (3) which is intended to be filled with concrete, each panel (1,2) being reinforced by horizontal stiffeners (4) and shores (5) being provided for maintaining the two panels in a vertical position and in spaced relation. The shore (5) are removably attached to the horizontal stiffeners (4) of one (2) of the panels, the panels being maintained in spaced relation by connecting the stiffeners (4) of one of the panels to the stiffeners of the other panel.

U.S. Pat. No. 5,655,337

Inventor: Carroll D. Bryant et al.

Issued: Aug. 12, 1997

The present invention relates to a drywall support device. More particularly, this invention relates to a drywall support device for temporarily attaching a sheet of drywall to a ceiling for easier permanent attachment by using a lift system to raise the sheet of drywall to the ceiling. This device is an elongated support which allows for "hands-free" permanent attachment of sheets of material to both conventional or irregularity sloped ceilings. The device has three essential components: (1) a pair of ceiling joist support brackets; (2) an elevatable drywall support; and (3) a threaded screw-type mechanism with a handle to raise the elevatable support to a desired elevation.

U.S. Pat. No. 5,564,236

Inventor: David McKinney et al.

Issued: Oct. 15, 1996

Disclosed and claimed is a deadman for temporarily holding panel material in position while the material is being fastened to a supporting structure, such as in wall and ceiling construction and methods of use.

U.S. Pat. No. 3,462,896

Inventor: Otto M. Lokensgaard

Issued: Aug. 26, 1969

Successive circular rows of concrete blocks are placed in an end-to-end relationship and one above the other on a lower circular ring having an angular cross section so that the horizontal flange thereof underlies the lower surface of the bottom row and the vertical flange confronts a portion of the outer surface of the bottom row. A second ring identical to the first ring is placed on the upper surface of the top row of concrete blocks with its horizontal flange overlying the upper surface of the top row and its vertical flange confronting an outer portion of said top row. A plurality of identical hook units are angularly spaced at the bottom and a similar number are angularly spaced at the top, the lower hook units having jaws that underlie the lower ring and bottom row and the upper hook units having jaws that overlie the upper ring and top row. Each hook unit is formed with a vertical passage or bore through which extend opposite ends of an elongated rod, there being a rod for each pair of lower and upper hook units. By means of a clamping nut threadedly engaged with each projecting end of each rod, the jaws call be pulled together to provide the necessary clamping force which prevents the individual blocks from shifting due to lateral pressure.

While these forms and methods for constructing support devices for forms may be suitable for the purposes for which they were designed, they would not be as suitable for the purposes of the present invention, as hereinafter described. The concrete blocks can be stacked one above the other at the ground level and then the soil removed from the interior of the cylindrical configuration constituting the septic tank or cesspool, thereby lowering all of blocks as a single unit. Also, the person installing the tank has the choice of digging a small excavation and the removing soil to lower the assemblage of blocks. Cave-ins and dislodgment of the concrete blocks is thereby obviated during installation.

SUMMARY OF THE PRESENT INVENTION

The present invention discloses a device to aid in providing ballast to place an object, e.g., a tank, underground. The device comprises a pair of generally horizontal elongated cylindrical members having a bell and spigot type end for being joined together. A pair of upstanding cylindrical members are provided on the horizontal cylindrical member for connection to a source of pumpable concrete. Concrete is pumped into one upright member and air is allowed to pass out the other upright member. Means are provided for closing the ends of the horizontal member so that concrete will not leak out, with the means using rebars and, e.g., steel tek. Means are also provided to the cylindrical members for attaching coupling cables thereto so that the object, e.g., a tank, can be properly ballasted.

A primary object of the present invention is to provide means for depositing a tank and deadman forms into an excavation site by automated means.

Another object of the present invention is to provide means for depositing a tank and deadman forms into an excavation site by automated means and partially backfilling the excavation, which reduces the hazardous condition of earth movement, before workmen enter said excavation.

Yet another object of the present invention is to provide means for depositing a tank and deadman forms into an excavation site by automated means thereby reducing the need for elaborate wall shoring members required for the presence of workmen in said excavation.

Still yet another object of the present invention is to provide means for depositing a tank and deadman forms into an excavation site by automated means wherein the form or forms are lightweight and have conduit-like members providing access to the main cavity.

Yet another object of the present invention is to provide means for depositing a tank and deadman forms into an excavation site by automated means wherein the form or forms are lightweight and have conduit-like members providing means for pumping a suitable material such as concrete into the form.

Additional objects of the present invention will appear as the description proceeds.

The present invention overcomes the shortcomings of the prior art by providing a lightweight ballast form, constructed from polypropylene, plastic fibers, or other durable lightweight composite materials. Said lightweight ballast form being comprised of a first container member having conduit-like second members providing means for access to said first container members cavity and forming an integral part of said first container member. Said second conduit-like members providing means for injecting a suitable material, such as concrete, into the cavity of said first container member and wherein more than one form can be connected together creating a form of selective length.

Further the form(s) can be strapped to a tank whereby the tank and ballast are placed into the excavation as one assembly and concrete or other suitable material can he pumped into one of the stack-like members without entering the excavation and the excavation can be backfilled to a predetermined level before personnel enter the excavation thereby reducing the job site risk of injury to personnel.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
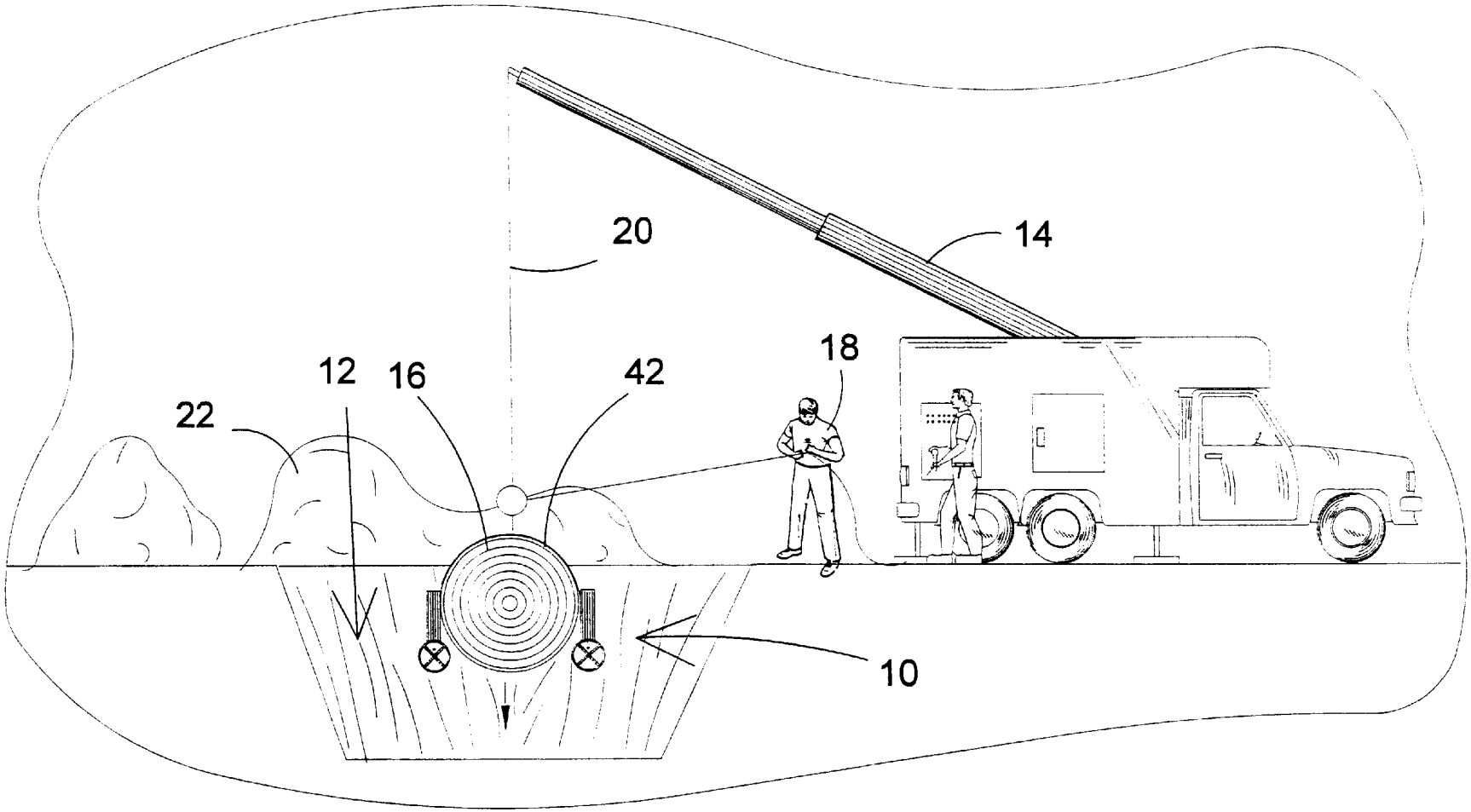
FIG. 1 is a perspective view of the present invention in use. Shown is an excavation site where a crane is being used to place and underground tank having the lightweight ballast forms attached thereto.

With regard to reference numerals used, the following numbering is used throughout the drawings.

10 present invention
12 excavation site
14 crane
16 tank
18 user
20 cable
22 soil
24 pump hose
26 stack member
28 means for connection
30 cylindrical member
34 short rebar
36 means for closure
38 open form end
40 eye bolt eyes
41 eye bolts
42 coupling cable
44 cavity
46 long rebar
48 concrete
50 air
52 steel tek
54 aperture
56 direction arrows
58 bell of pipe
60 end of pipe
62 flange
64 tar paper-like material
66 metal frame
68 nut

DESCRIPTION OF THE PREFERRED EMBODIMENT(S)

Turning now descriptively to the drawings, in which similar reference characters denote similar elements throughout the several views. FIGS. 1 through 8 illustrate the present invention being a concrete form for a ballast.

Turning to FIG. 1, shown therein is a perspective view of the present invention 10 in use. Shown is an excavation site 12 where a crane 14 is being used to place an underground tank 16 having the lightweight ballast forms 10 attached thereto. Also shown is a user 18 along with crane cable or line 20 for hoisting tank 16 along with soil 22. Also shown is a coupling cable 42 which joins the two ballast forms 10 together and travels over the top of tank 16 to hold it down.

Figure 1A:
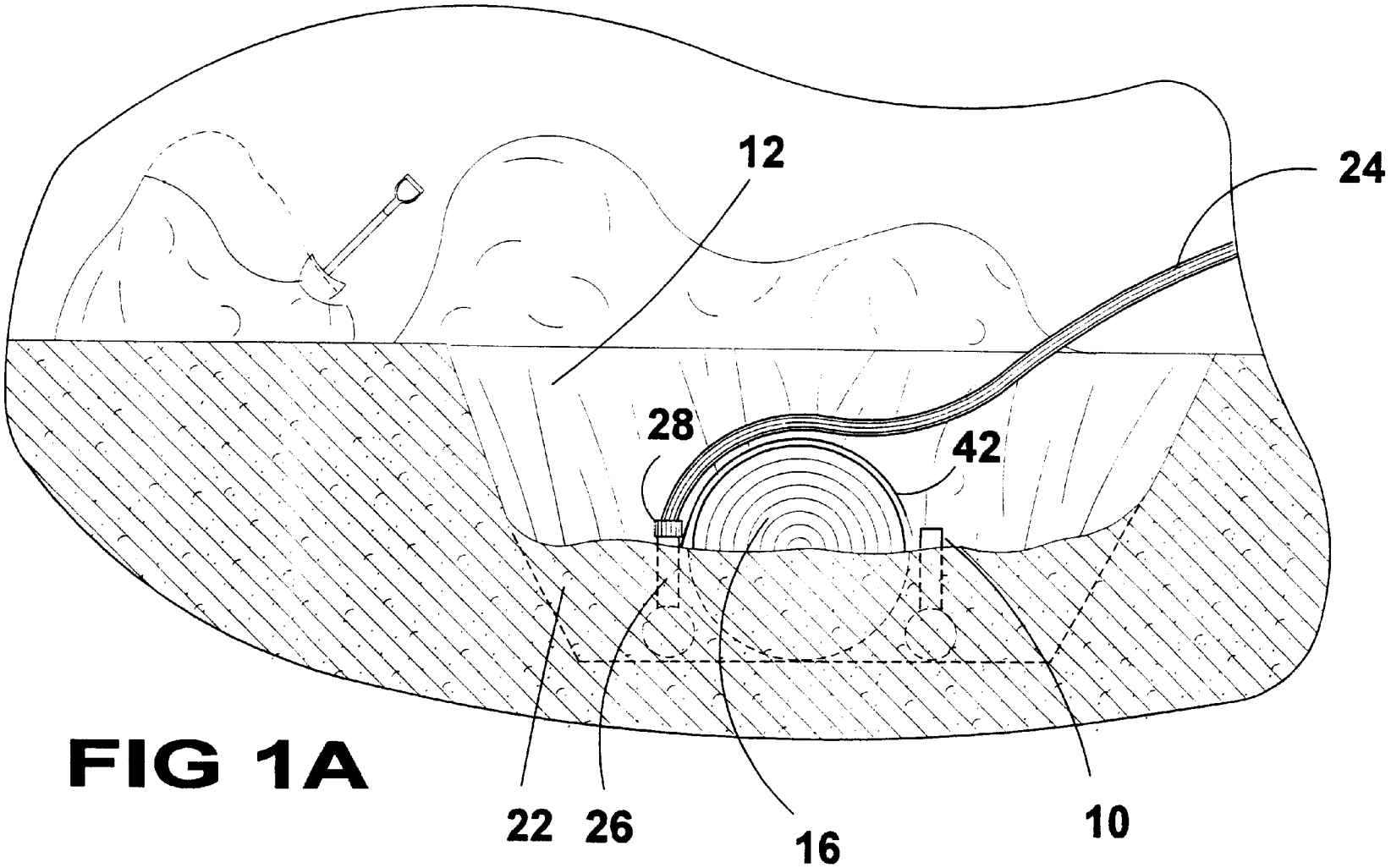
FIG. 1A is a perspective view of the present invention in use. Shown is an excavation site where an underground tank and lightweight ballast forms have been installed into an excavation which has been backfilled and a pump hose has been attached to one of the stacks of the lightweight ballast forms for the purpose of filling the form with an appropriate material such as concrete.

Turning to FIG. 1A, shown therein is a perspective view of the present invention 10 in use. Shown is an excavation site 12 where an underground tank 16 and lightweight ballast forms 10 have been installed into an excavation which has been partially backfilled with soil 22 and a pump hose 24 has been connected by means 28 to one of the stacks 26 of the lightweight ballast forms 10 for the purpose of filling the form 10 with an appropriate material such as pumpable or flowable concrete. Coupling cable 42 is also shown.

Figure 2:
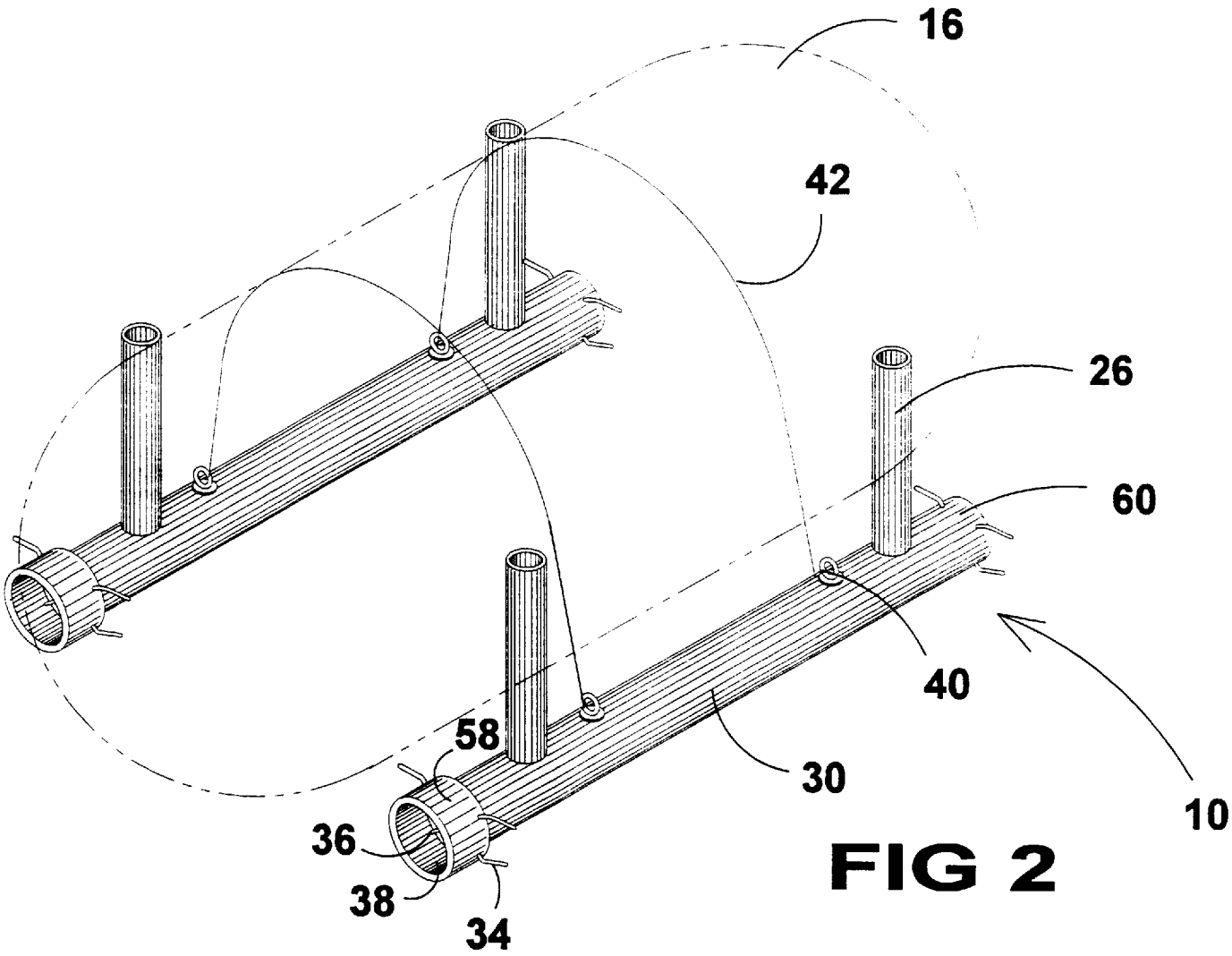
FIG. 2 is an illustration of the present invention attached to an underground tank shown in outline. The lightweight ballast form is comprised of a cylindrical member having stack-like members forming an integral unit providing means for inserting a suitable ballast material, such as concrete, into one stack member as air is displaced out the other stack-like member. Also shown are lengths of rebar which are used to hold pieces of steel tek acting as means closure for the lightweight ballast form distal ends.

Turning to FIG. 2, shown therein is an illustration of the present invention 10 attached to an underground tank 16, shown in outline. The lightweight ballast form 10 is comprised of a pair of generally horizontal cylindrical members 30 having a pair of upright standing stack-like members 26 forming an integral unit providing means for inserting a suitable ballast material, such as concrete, into one stack member as air is displaced out the other stack-like member. Also shown are lengths of short pieces of steel reinforcing bars or rebar 34 which are used to hold pieces of steel tek acting as means of closure 36 for the lightweight ballast form distal ends 38 which are open. Eyebolt eyes 40 are shown with coupling cable 42 contacting the tank 16. Also shown is an enlarged female or bell end 58 and a non-enlarged male spigot end 60 whereby the pipes can be joined together.

Figure 3:
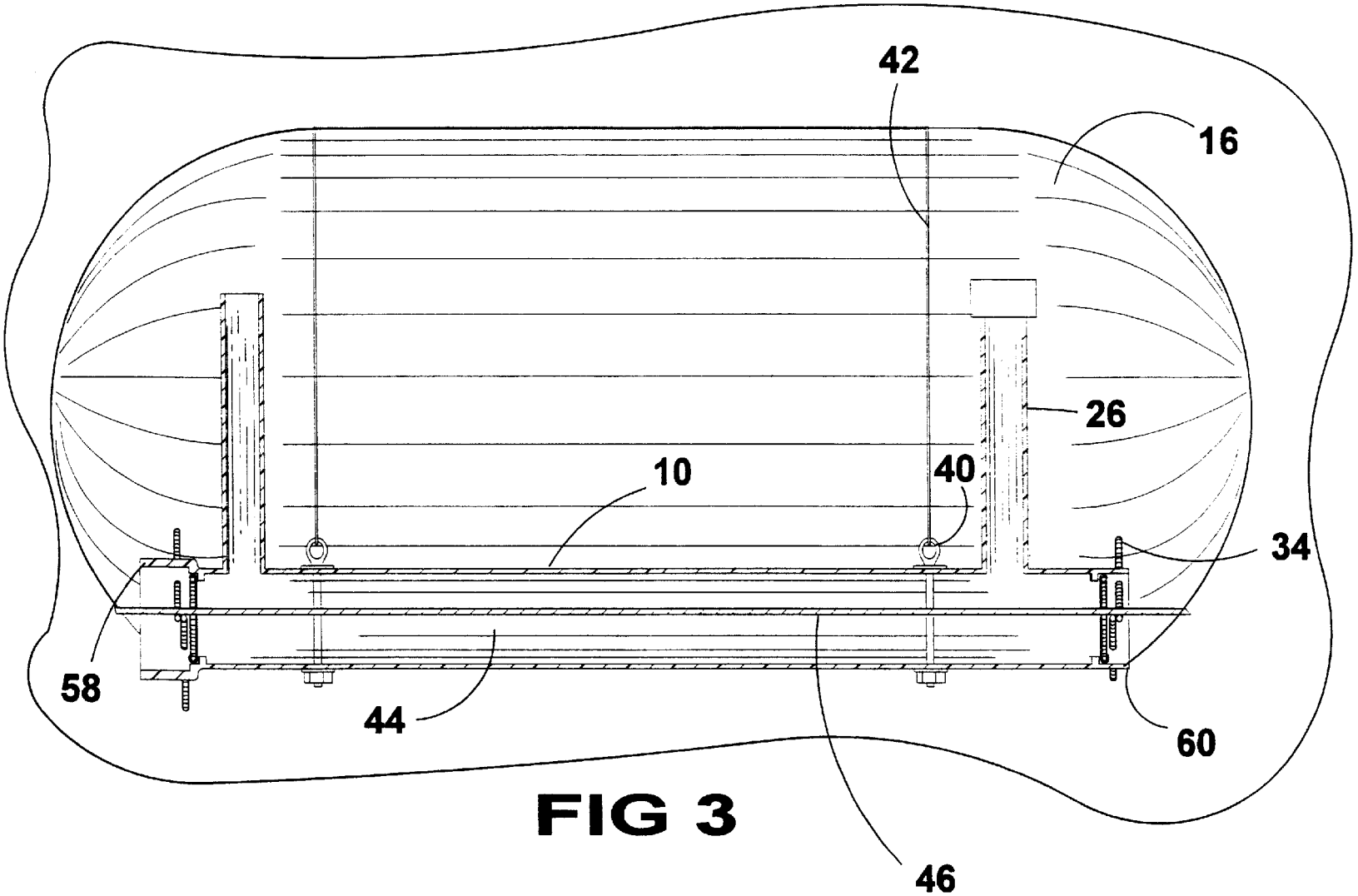
FIG. 3 is a cross section of the present invention, taken from FIG. 2 as indicated. Shown is the cavity of the lightweight ballast form having a length of rebar positioned therein and having two stack-like members providing means for pumping an appropriate ballast material into one stack-like member as air is displaced out through the other member. Also shown are short lengths of rebar installed through each distal end to hold a capping material, such as steel tek, in place. Also shown is the anchoring means for holding the cable between the lightweight ballast forms.

Turning to FIG. 3, shown therein is a cross section of the present invention 10, taken from FIG. 2 as indicated. Shown is the inner cavity 44 of the lightweight ballast form 10 having a length of rebar 46 positioned longitudinally therein and having two stack-like members 26 providing means for pumping an appropriate ballast material into one stack-like member as air is displaced out through the other member. Also shown are short lengths of rebar 34 installed through each distal end to hold a capping material, such is steel tek, in place. Also shown is the anchoring means 40 for holding the cable 42 between the lightweight ballast form 10 which joins the ballast 10 and anchors the tank 16. Ends of pipe 58, 60 are also shown.

Figure 4:
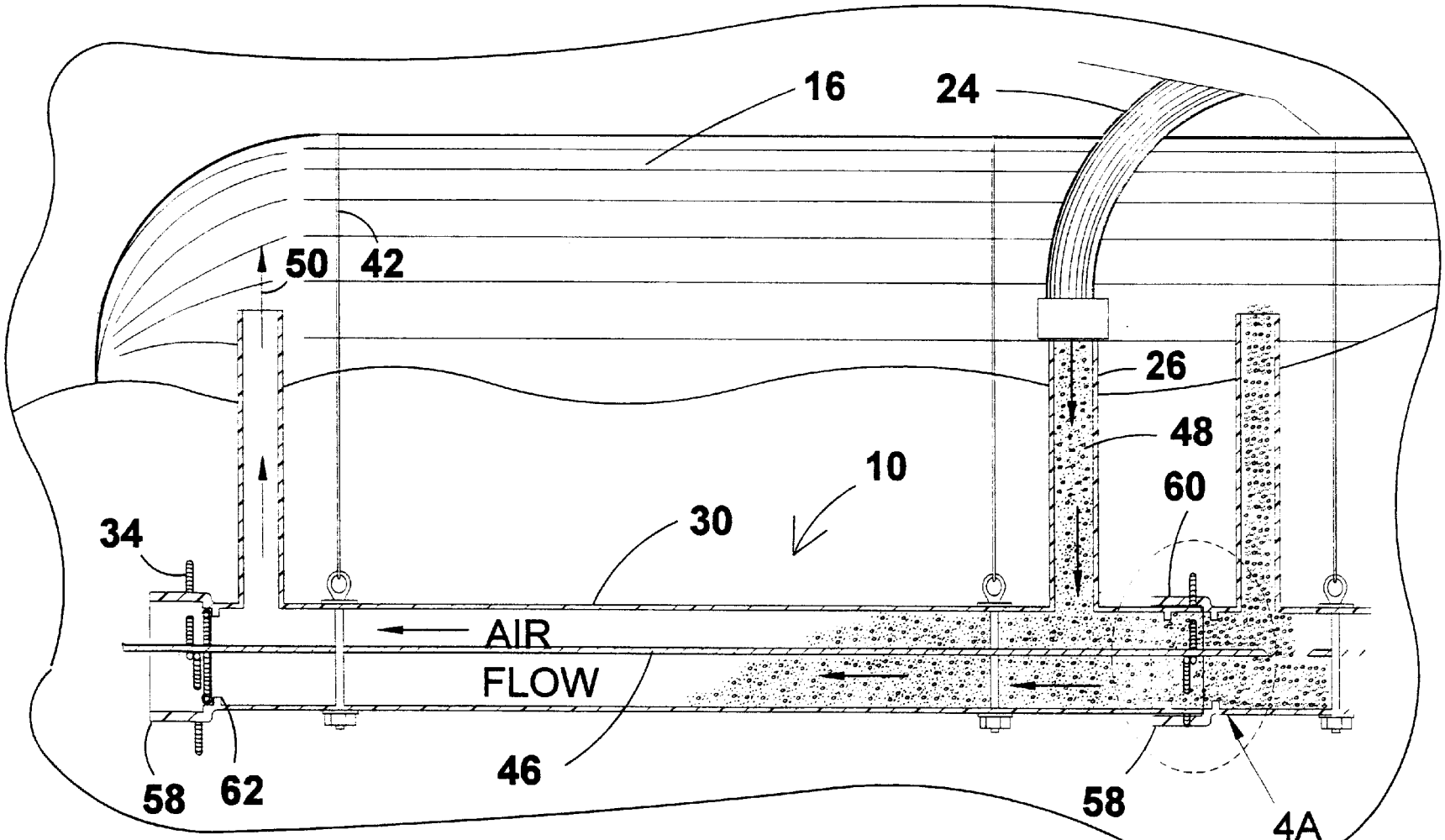
FIG. 4 is a diagrammatic view of the present invention having a pump hose connected to one of the stack-like members having concrete pumped into the lightweight ballast form as air is being displaced out the other stack-like member. Also shown are short lengths of rebar installed through each distal end holding a capping material, such as steel tek, in place.

Turning to FIG. 4, shown therein is a diagrammatic view of the present invention 10 having a pump hose 24 connected to one of the stack-like members 26 having concrete 48 pumped into the lightweight ballast form 10 as air 50 is being displaced out the other stack-like member. Also shown are short lengths of rebar 34 installed through each distal end holding a capping material, such as steel tek, in place along with rebar 46 and other features previously disclosed. Bell flange 62 is also shown.

Figure 4A:
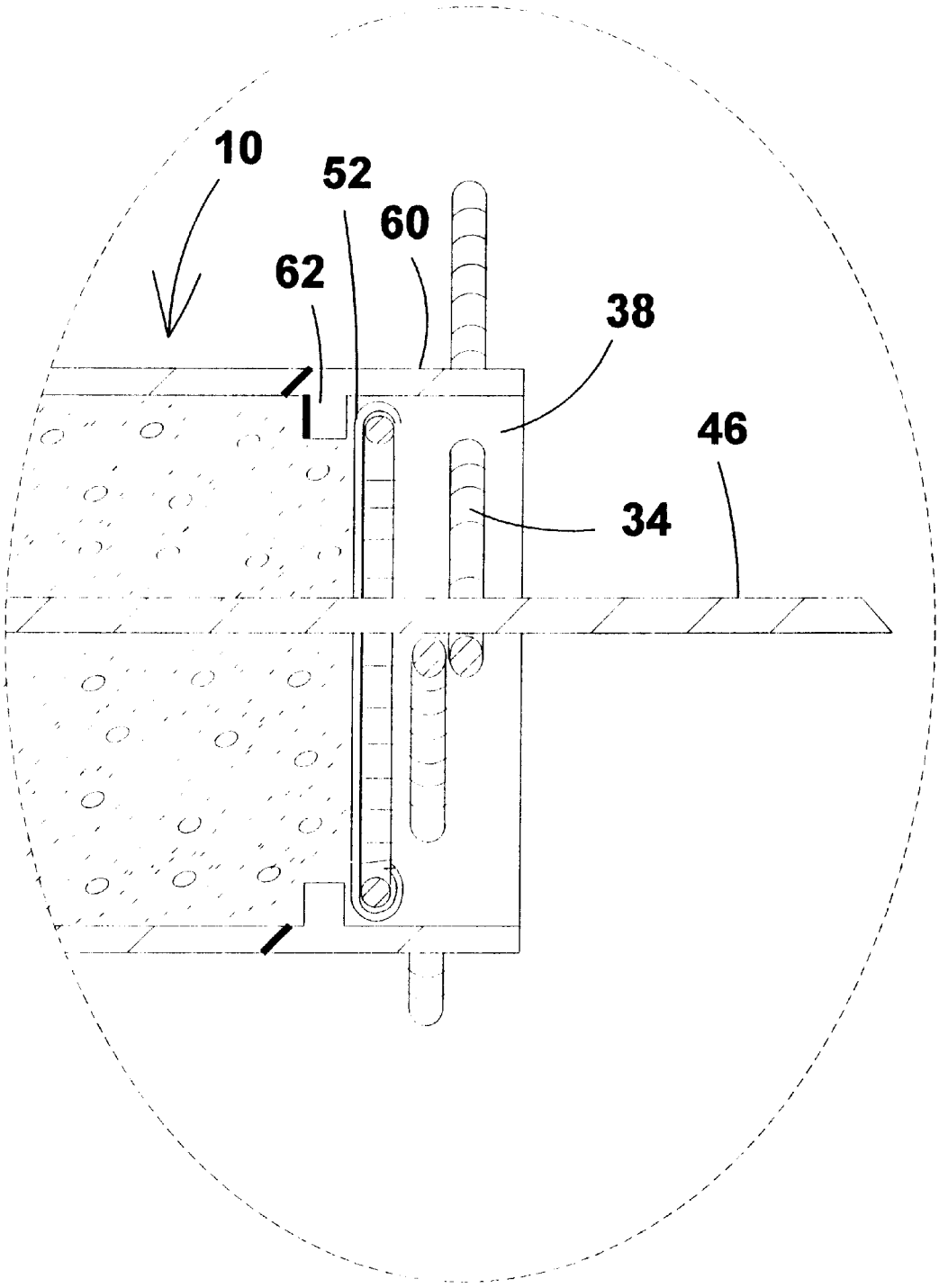
FIG. 4A is an enlarged view, taken from FIG. 4 as indicated. Shown is one means of capping the distal ends of the lightweight ballast form wherein a piece of steel tek has been cut to fit the opening and placed inside the distal end of the form and pieces of rebar are inserted through the pipe holding the capping material in place.

Turning to FIG. 4A, shown therein is an enlarged view, taken from FIG. 4 as indicated. Shown is one means of capping the open ends 38 of the lightweight ballast form 10 wherein a piece of steel tek 52 has been cut to fit the opening and placed inside the distal end of the form and pieces of rebar 34 are inserted through the pipe holding the capping material 52 in place adjacent a flange 62 of the spigot end 60. Rebar 46 is also shown.

Figure 5:
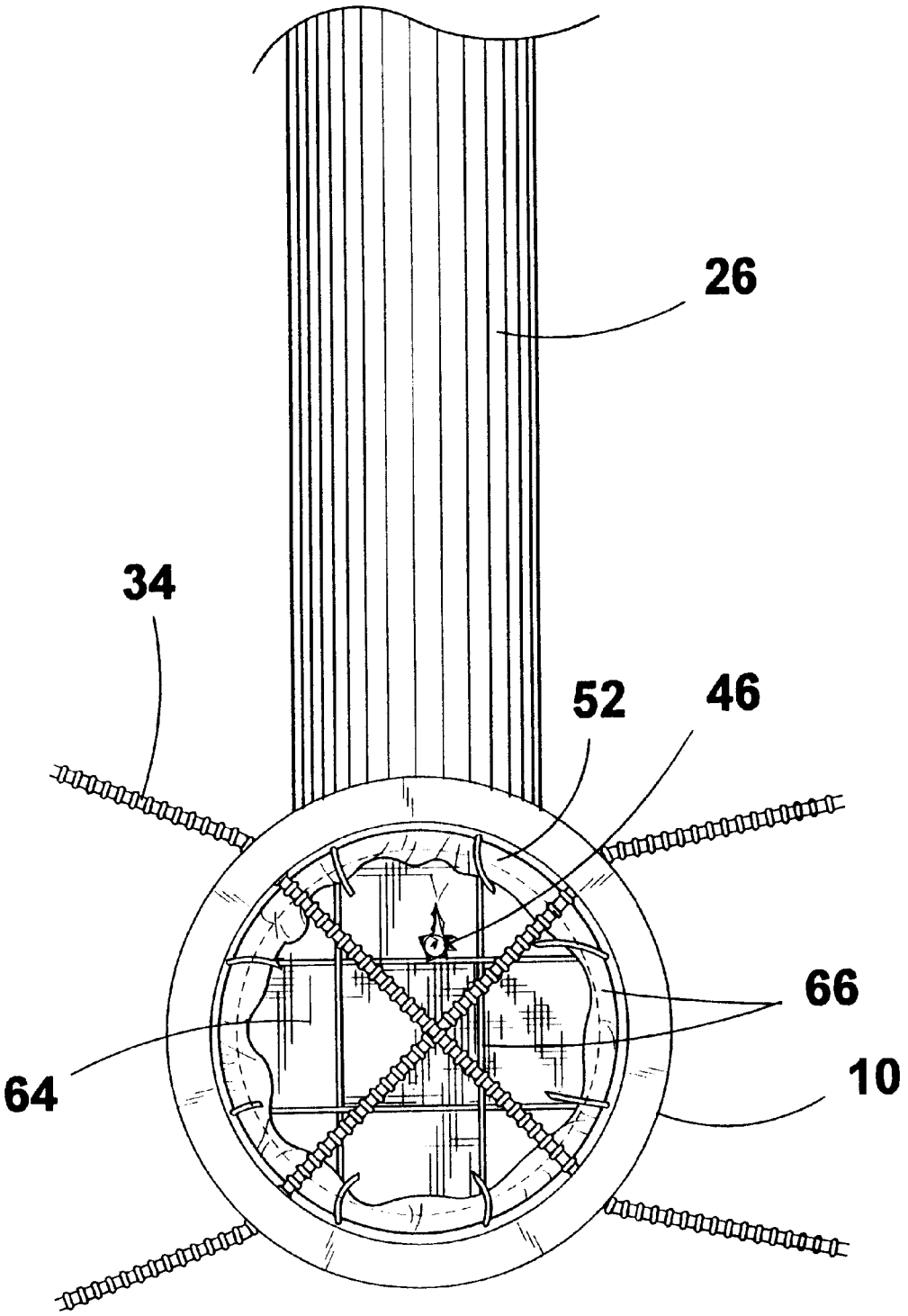
FIG. 5 is an end view of the present invention, taken from FIG. 4 as indicated. Shown is a material, such as steel tek, cut to size and inserted into the distal end of the lightweight ballast form performing closure of the distal ends of the form as well as providing support for reinforcement rods inserted lengthwise through the lightweight ballast form. Also shown is one means of maintaining the positioning of the capping material by placing reinforcement rods through the structure of the lightweight ballast form.

Turning to FIG. 5, shown therein is an end view of the present invention, taken from FIG. 4 as indicated. Shown is a material, such as steel tek 52, cut to size and inserted into the distal end of the lightweight ballast form 10 performing closure of the distal ends of the form 10 as well as providing support for reinforcement rods 46 inserted lengthwise through the lightweight ballast form 10. Also shown is one means of maintaining the positioning of the capping material 52 by placing reinforcement rods 34 through the structure of the lightweight ballast form 10. Steel tek 52 is a tar paper-like material 64 woven over a metal frame 66. Stack member 26 is also shown.

Figure 6:
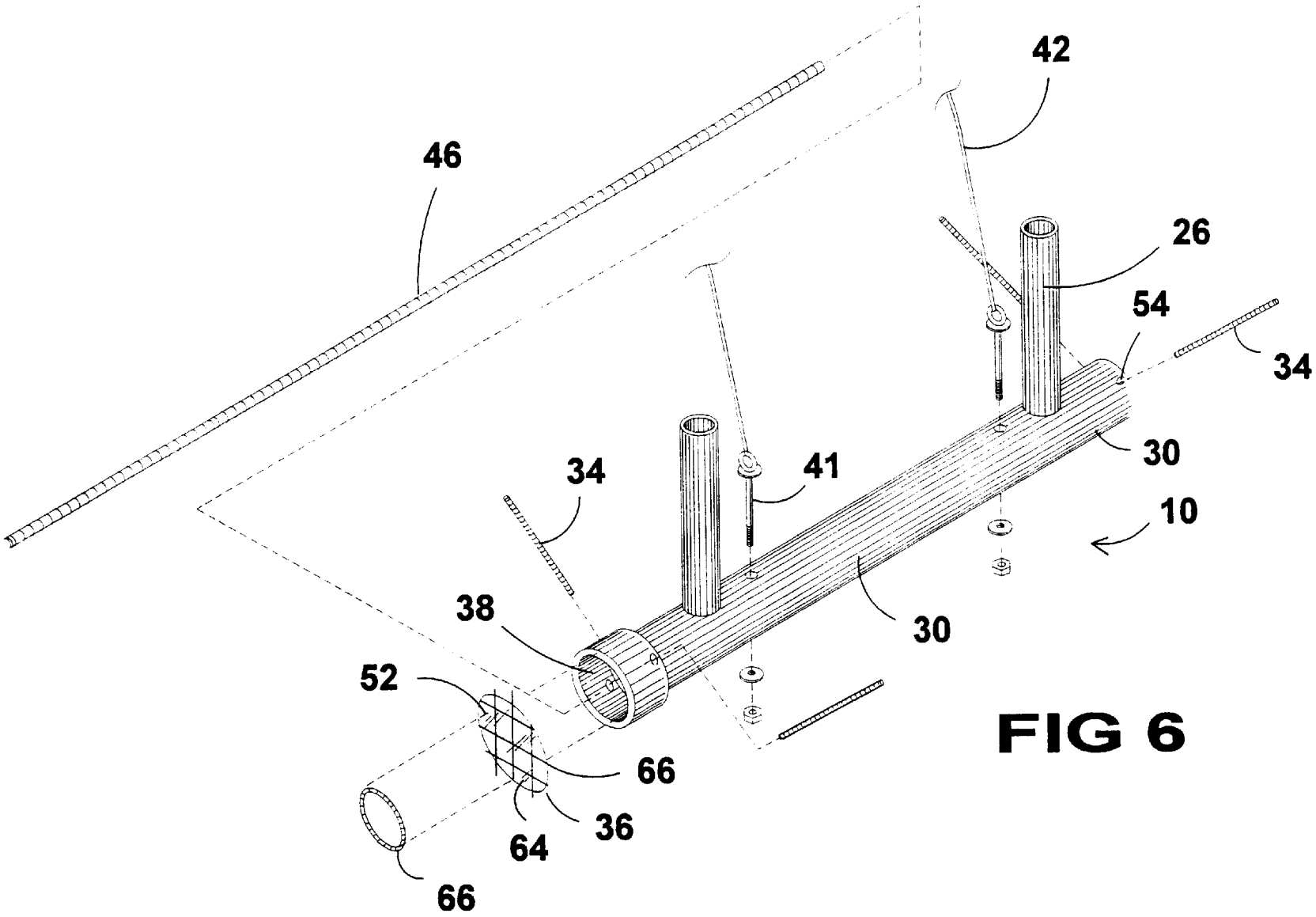
FIG. 6 is an exploded view of the component of the preferred embodiment of the present invention. Shown is the lightweight ballast form being a basically cylindrical tube having stack-like members providing means for access the cavity of the ballast form wherein will be pumped an appropriate material such as concrete after the tank and form are placed in an excavation. Also shown are anchoring pins used to attach the belting material from one ballast member to the other. Also shown are means of closure for the distal ends of the ballast form which may be comprised of steel tek, a tar like paper material woven over a metal frame, which is cut to size and inserted into the open ends of the ballast form and held in place by a number of pieces of rebar which is inserted through apertures in the structure ends of the ballast form.

Turning to FIG. 6, shown therein is an exploded view of the components of the preferred embodiment of the present invention 10. Shown is the lightweight ballast form being a basically cylindrical tube 30 having two stack-like members 26 providing means for access to the cavity of the ballast form wherein will be pumped an appropriate material such as concrete after the tank and form are placed in an excavation. Also shown are anchoring pins 41, or eyebolts used to attach the belting material 42 from one ballast member 10 to the other. Also shown are means of closure 36 for the distal ends of the ballast form which may be comprised of steel tek 52, a tar like paper material 64 woven over a metal frame 66, which is cut to size and inserted into the open ends 38 of the ballast form 10 and held in place by a number of pieces of rebar 34 which is inserted through aperatures 54 which are effectively close to the ends 38 of the ballast form 10 to close the ends thereof. Rebar 46 is also shown.

Figure 7:
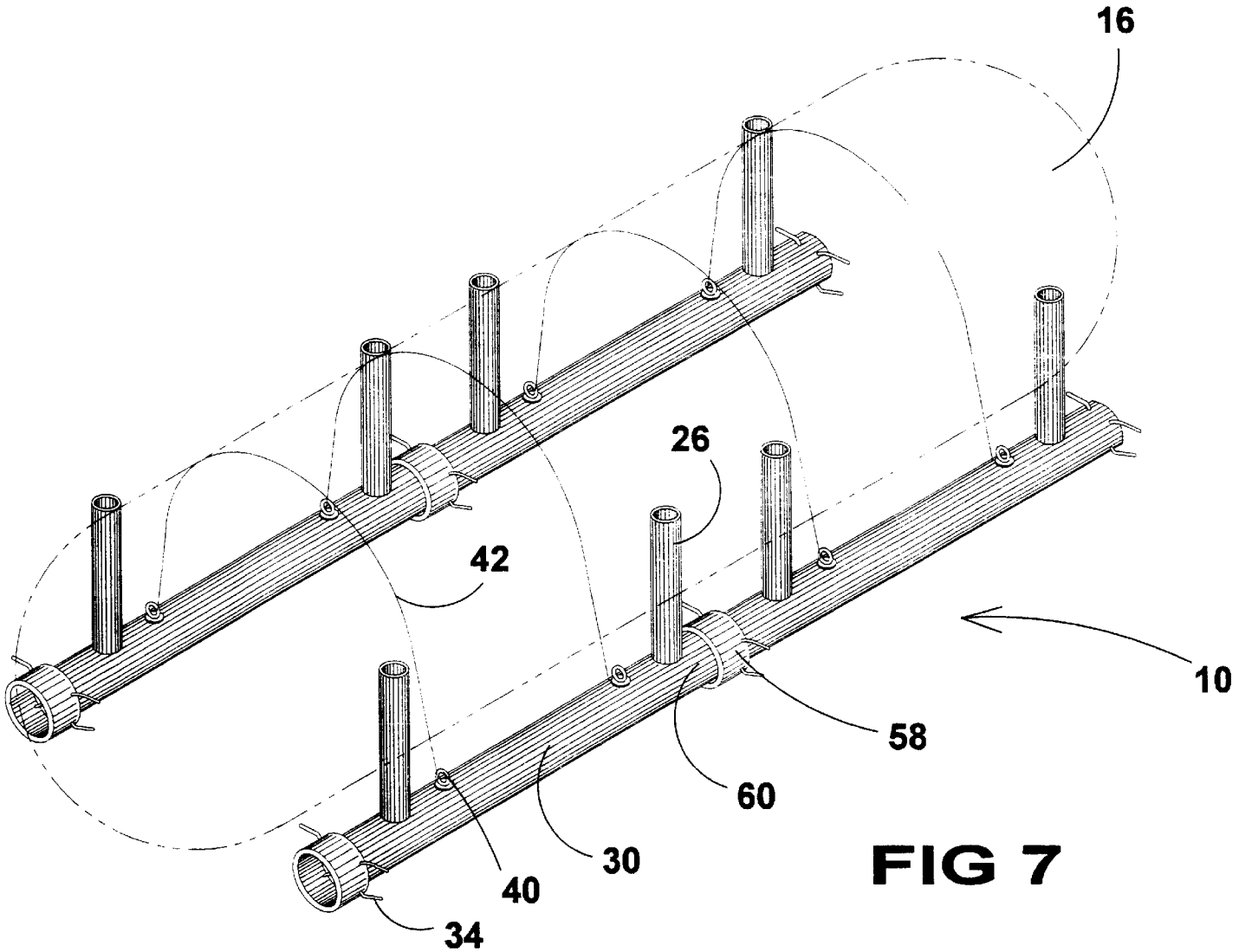
FIG. 7 is a perspective view of an alternate configuration of the preferred embodiment of the present invention attached to an underground tank, shown in outline wherein two of the lightweight ballast forms are joined together by appropriate means, such as gluing. The lightweight ballast form is comprised of a cylindrical member having stack-like members forming an integral part thereof providing means for inserting a suitable ballast material, such as concrete, therein. Also shown are lengths of rebar which are used to hold pieces of steel tek acting as means of closure for the lightweight ballast form distal ends.

Turning to FIG. 7, shown therein is a perspective view of an alternate configuration of the preferred embodiment of the present invention 10 attached to an underground tank 16, shown in outline wherein two of the lightweight ballast forms 10 are joined together by appropriate means, such as gluing the bell 58 and spigot end 60 together as done by one skilled in the art in the standard manner. The lightweight ballast form is comprised of a cylindrical member 30 having stack-like members 26 forming an integral part thereof providing means for inserting a suitable ballast material such as concrete, therein. Also shown are lengths of rebar 34 which are used to hold pieces of steel tek (not shown) acting as means of closure for the lightweight ballast form distal ends. Cables 42 and eyebolt ties 40 are also shown.

Figure 8:
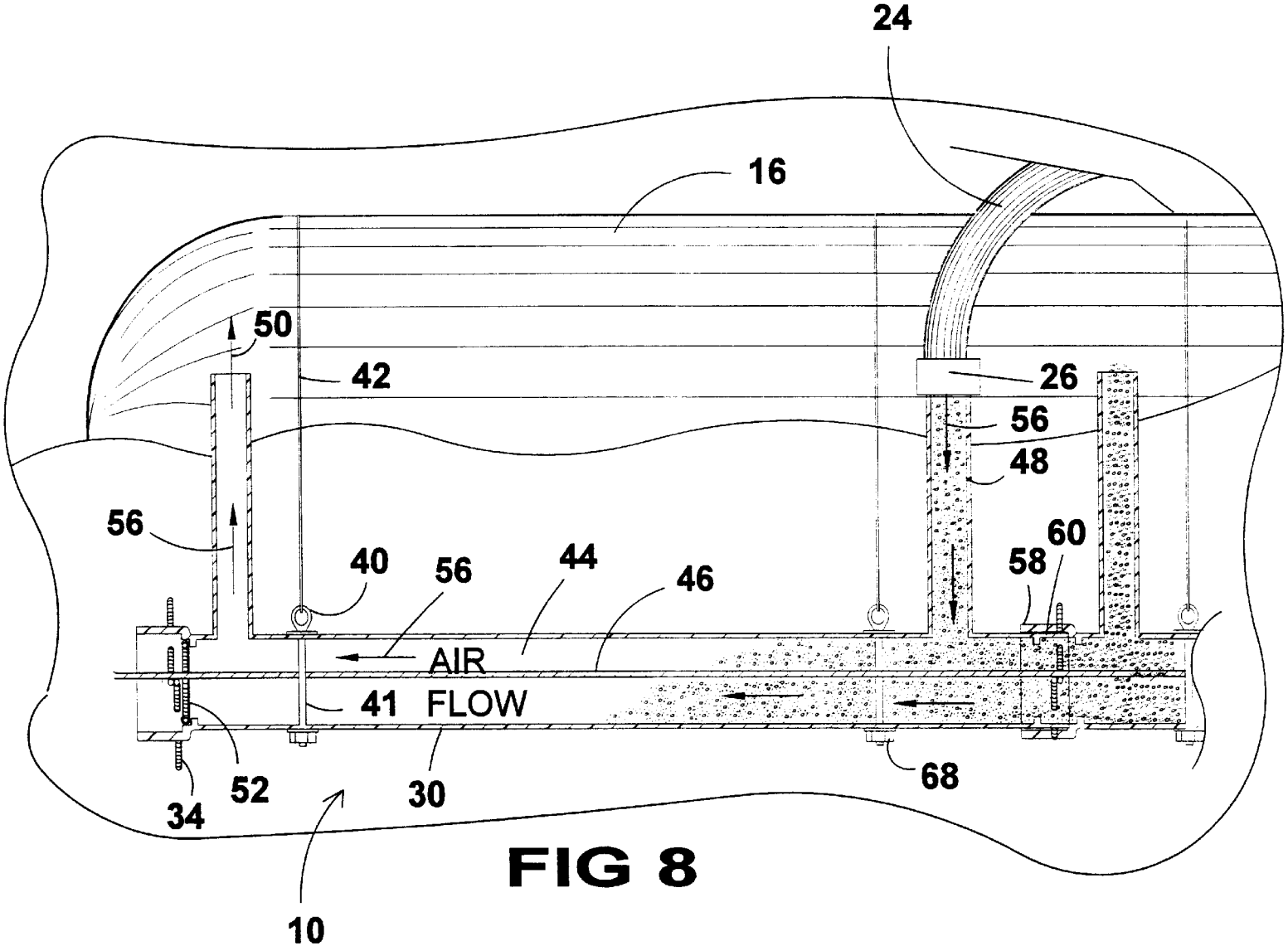
FIG. 8 is a diagrammatic view of the present invention having a pump hose connected to one of the stack-like members having concrete pumped into the lightweight ballast form as air is being displaced out the other stack-like member. Shown is the cavity of the joined lightweight ballast forms having a length of rebar positioned therein and each having two stack-like members providing means for pumping an appropriate ballast material into one stack-like member as air is displaced out through the other member. Also shown are short lengths of rebar installed through each distal end to hold a capping material, such as steel tek, in place, and short lengths of rebar installed through the joining ends of the lightweight ballast forms. Also shown is the anchoring means for holding the cable between the lightweight ballast forms.

Turning to FIG. 8, shown therein is a diagrammatic view of the present invention 10 having a pump hose 24 connected to one of the stack-like members 26 having concrete 48 pumped into the lightweight ballast form as air 50 is being displaced out the other stack-like member. Shown is the cavity 44 of the joined lightweight ballast forms having a length of rebar 46 positioned therein and each having two stack-like members providing means for pumping an appropriate ballast material into one stack-like member as air is displaced out through the other member as shown by direction arrows 56. Also shown are short lengths of rebar 34 installed through each distal end to hold a capping material 52, such as steel tek, in place, and short lengths of rebar 34 installed through the joining ends 58, 60 of the lightweight ballast forms. Also shown is the anchoring means 40, 41 for holding the cable 42 between the lightweight ballast forms with means for securing 68, e.g., nuts, the eyebolts 41 to member 30. Tank 16 is also shown.

What is claimed to be new and desired to be protected by Letters Patent is set forth in the claims:

1. An apparatus for forming concrete to provide ballast to an object, comprising:

a) a pair of elongated generally horizontally positioned cylindrical members;

b) a pair of upright standing cylindrical members joined to each of said pair of generally horizontal cylindrical members;

c) means for closing the open ends of said generally horizontal cylindrical member;

d) a source of pumpable concrete;

e) means for attaching said source of concrete to a first member of said pair of upright standing cylindrical member, said concrete flowing into said generally horizontal cylindrical member; and, f) means for connecting said horizontal members to said object.

2. The apparatus of claim 1, further comprising a bell on one end of said generally horizontal cylindrical member.

3. The apparatus of claim 2, further comprising a spigot on one end of said generally horizontal cylindrical member.

4. The apparatus of claim 3, further comprising means for connecting said bell of a first horizontal cylindrical member to said spigot of a second horizontal cylindrical member, said pair of horizontal cylindrical members being joined together.

5. The apparatus of claim 4, said means for connecting further comprises said spigot inserted into said bell, said horizontal cylindrical members being joined together.

6. The apparatus of claim 5, said means for connecting further comprises an adhesive material applied to said bell and to said spigot, said horizontal cylindrical members being joined together.

7. The apparatus of claim 1, said means for closing further comprises a plurality of reinforcing bars, said bars passing across said open ends of said generally horizontal cylindrical member.

8. The apparatus of claim 7, said generally horizontal cylindrical members having apertures therein, said apertures located in the walls of said generally horizontal cylindrical member, said apertures located effectively near the ends of said generally horizontal cylindrical member, said reinforcing bars positioned in said apertures.

9. The apparatus of claim 8, said means for closing further comprising a capping material.

10. The apparatus of claim 9, said capping material further comprising steel tek, said steel tek further comprising a tar paper material, said tar paper material positioned over a metal frame, said steel tek capping the open end of said horizontal cylindrical member.

11. The apparatus of claim 1, further comprising rebar running longitudinally through said generally horizontal cylindrical member.

12. The apparatus of claim 1, further comprising a means for connecting a coupling cable to said generally horizontal cylindrical members.

13. The apparatus of claim 12, said means for connecting further comprising multiple eye bolts passing through said generally horizontal cylindrical member, having means for connecting said eyebolts to said coupling cable.

14. The apparatus of claim 12, further comprising said coupling cable positioned over a proximate object to be buried, said coupling cable joining said pair of horizontal cylindrical members to said proximate object.

15. The apparatus of claim 6, wherein a plurality of horizontal cylindrical members are joined together.

* * * * *